US008176822B1

(12) United States Patent
Halfen

(10) Patent No.: US 8,176,822 B1
(45) Date of Patent: May 15, 2012

(54) HOLE PUNCH AND COMPRESSOR WITH ALIGNMENT MEMBER

(75) Inventor: Marvin J. Halfen, Hastings, MN (US)

(73) Assignee: Smead Manufacturing Company, Hastings, MN (US)

( * ) Notice: Subject to any disclaimer, the term of this patent is extended or adjusted under 35 U.S.C. 154(b) by 20 days.

(21) Appl. No.: 12/954,293

(22) Filed: Nov. 24, 2010

Related U.S. Application Data

(63) Continuation of application No. 11/316,121, filed on Dec. 22, 2005, now abandoned.

(60) Provisional application No. 60/638,900, filed on Dec. 22, 2004.

(51) Int. Cl.
*B42F 13/40* (2006.01)

(52) U.S. Cl. ..... 83/453; 83/467.1; 83/687; 30/363; 402/1; 402/4

(58) Field of Classification Search ..... 83/453, 83/467.1, 599, 687, 698.91; 30/358–361, 30/363; 402/1, 4, 24, 7
See application file for complete search history.

(56) References Cited

U.S. PATENT DOCUMENTS

| | | | | |
|---|---|---|---|---|
| 549,660 | A | 11/1895 | Rodden | |
| 1,204,899 | A | 11/1916 | Niebling | |
| 1,222,073 | A | 4/1917 | Cooke, Jr. | |
| 1,285,048 | A * | 11/1918 | Cooke | 30/316 |
| 1,336,998 | A | 4/1920 | Bottle | |
| 2,139,159 | A | 12/1938 | Hammen | |
| 2,370,319 | A | 2/1945 | Lippincott | |
| 2,659,512 | A | 11/1953 | Czerniawski | |
| 2,877,772 | A | 3/1959 | Furrer et al. | |
| 3,023,474 | A | 3/1962 | Shears | |
| 3,303,564 | A | 2/1967 | Hendricks | |
| 3,826,582 | A | 7/1974 | Podosek | |
| 3,975,105 | A | 8/1976 | Cline | |
| 4,155,607 | A | 5/1979 | Sitler et al. | |
| 4,219,247 | A | 8/1980 | Litchfield et al. | |
| 4,681,232 | A | 7/1987 | Du Corday | |
| 4,729,688 | A * | 3/1988 | Manz | 402/1 |
| 4,749,297 | A | 6/1988 | Roy | |
| 4,790,680 | A | 12/1988 | Givati et al. | |
| 4,928,361 | A | 5/1990 | Brown | |
| 4,991,269 | A | 2/1991 | Kuroda | |
| 5,048,697 | A | 9/1991 | Payne | |
| 5,056,748 | A | 10/1991 | Meyer | |
| 5,136,754 | A | 8/1992 | Kuroda | |
| 5,154,527 | A | 10/1992 | Blessing | |
| 5,214,825 | A | 6/1993 | Hirzel | |
| 5,226,215 | A | 7/1993 | Evenson | |
| 5,295,622 | A | 3/1994 | Lorber | |
| 5,340,229 | A | 8/1994 | Schwartzman | |

(Continued)

FOREIGN PATENT DOCUMENTS

| | | |
|---|---|---|
| GB | 2092525 | 8/1982 |

(Continued)

*Primary Examiner* — Phong Nguyen
(74) *Attorney, Agent, or Firm* — Altera Law Group, LLC

(57) ABSTRACT

Disclosed is a multi-function paper handling device primarily for use on pronged papers holders, typically two-pronged, which normally employ a compressor plate to hold papers which are spindled on the prongs. Instead of a compressor plate, the device replaces that function while simultaneously providing a hole punch which provides the holes for the prongs. The punch can also include an alignment guide, a letter opener or other features. A method of manufacture is also disclosed.

6 Claims, 9 Drawing Sheets

U.S. PATENT DOCUMENTS

| | | | | |
|---|---|---|---|---|
| 5,386,638 | A | | 2/1995 | Weber |
| 5,429,445 | A | | 7/1995 | Un-tae |
| 5,490,440 | A | * | 2/1996 | Karlis et al. ..... 83/599 |
| 5,503,052 | A | | 4/1996 | Rigney et al. |
| 5,553,958 | A | * | 9/1996 | Bedol ..... 402/1 |
| 5,593,242 | A | | 1/1997 | Mathias |
| 5,906,448 | A | | 5/1999 | Najmi |
| 5,942,293 | A | | 8/1999 | Occhipinti et al. |
| 6,109,456 | A | | 8/2000 | Heinz |
| 6,382,864 | B1 | | 5/2002 | Moor |
| 6,581,501 | B2 | | 6/2003 | McGrath |
| 6,725,508 | B1 | | 4/2004 | Noda et al. |
| 2002/0010984 | A1 | | 1/2002 | Kumagai |
| 2003/0208887 | A1 | | 11/2003 | Lee |
| 2004/0007544 | A1 | | 1/2004 | MacKelvie |
| 2004/0045137 | A1 | | 3/2004 | Hsiao |

FOREIGN PATENT DOCUMENTS

| | | |
|---|---|---|
| GB | 2254291 | 10/1992 |
| JP | 09-286193 | 11/1997 |
| WO | WO 93/13948 | 7/1993 |

* cited by examiner

HOLE PUNCH AND COMPRESSOR WITH ALIGNMENT MEMBER

CROSS-REFERENCE TO RELATED APPLICATIONS

This application is a continuation of application Ser. No. 11/316,121, filed 22 Dec. 2005 now abandoned, which claims the benefit of U.S. Provisional Application Ser. No. 60/638,900 filed on 22 Dec. 2004, the complete subject matter of each of which is hereby incorporated herein by reference in its entirety.

FIELD OF THE INVENTION

The present invention is directed to a paper handling device including hole punching.

BACKGROUND

In an office setting, it is common to use files in which holes are punched in each page of the file contents, and the file contents are held together through the punched holes. It is commonplace to first punch two holes along the top edge of each page in a file, then insert each page onto a pair of flexible prongs which form a binder that secures the pages by the holes. This "prong binder" is secured to the file, either through holes in the folder or by an attachable element or by being integrated into the file itself, and in turn attaches all the file contents to the file through the punched holes at the top of each page. Common binders may use metal or plastic strips that protrude through the holes. The compressor plate is then slipped over the prongs, the prongs are bent and the papers are then held compressed together. Sometimes the compressors have further locking means to prevent the prongs from coming free from their bent position, but generally these are unnecessary, or unused as the strength of the prongs themselves prevents removal of the compressor.

The binders generally affix the file contents through the punched holes, but the holes are generally punched by an external punch. This is often inconvenient, as an external punch must be on hand if a document is to be added to the file. These external punches are generally quite large and expensive, and are not nearly as easily transported as the files themselves. Furthermore, if the spacing between the holes in the file is not the same as the punch, as may be the case if a European-sized file is examined in an office that only has a U.S.-sized punch, then documents are not easily added to the file.

More importantly, the punch is rarely conveniently available when papers are to be inserted into the binder.

One sure way to make the punch available is to make sure that it is indispensable to the operation of the prong binder/compressor system.

Accordingly, there exists a need for a hole punch that is relatively small and inexpensive which may be contained in the file itself, thereby eliminating the need for an external hole punch when documents are added to the file.

SUMMARY

There are several aspects to the invention. Reference should be had to the detailed description and the claims. For the reader's convenience a summary of some of salient features appears below.

For example, the invention includes a multifunction paper punch-compressor device for use with a multi-prong paper binder, having a first member having a first edge and at least two spaced apart apertures, a second member having a first edge and at least two spaced part apertures; said first edge of said first and second members being pivotally and resiliently joined, having a relaxed state where said members define a gap therebetween at said apertures and a compressed state wherein said member are in at least partial contact, said apertures of said first and second members being substantially co-axially aligned; a hole punch formed from said first and second members around said apertures, and configured to punch holes in papers when said device is in a compressed state; said apertures spaced apart at a predetermined distance to receive said prongs and to act as a compression plate to maintain the papers confined between the multi-prong binder and said device.

In another embodiment, the invention includes a paper punch-alignment device for use with a multi-prong paper binder, having a first member having a first edge and at least two spaced apart apertures, a second member having a first edge and at least two spaced part apertures; said first edge of said first and second members being pivotally and resiliently joined, having a relaxed state where said members define a gap therebetween at said apertures and a compressed state wherein said member are in at least partial contact, said apertures of said first and second members being substantially co-axially aligned; a hole punch formed from said first and second members around said apertures, and configured to punch holes in papers when said device is in a compressed state; said apertures spaced apart at a predetermined distance to receive said prongs and to act as a compression plate to maintain the papers confined between the multi-prong binder and said device; an alignment arm extending from one of said members generally along an axis passing through said apertures, said arm having a generally planar extension and being bounded by at least one side wall extending generally orthogonally from extension, so that a paper may be aligned against said side wall prior to punching to receive holes in a predetermined location.

Another embodiment includes a method of making a multifunction hole punch and paper compressor device for use on a multi-prong paper binder, comprising the steps of; determining the standard prong spacing of a multi-prong binder; folding over a single sheet material onto itself to form a pair of substantially planar members joined at one edge thereof; placing spaced apart apertures of said standard spacing in one of said planar members, said apertures being of predetermined diameter; forming similarly spaced apart apertures in the other planar member, said apertures of the planar members being coaxially aligned, forming a circumferential lip on the inside circumference of the one set of apertures, said lip having an outer diameter smaller than said predetermined diameter; so that said device may function both as a paper punch and a the compressor for the multi-pronged binder.

This summary is just exemplary. Reference should be had to the detailed description for further inventive concepts and to the claims.

DETAILED DESCRIPTION OF THE INVENTION

Figure 1:
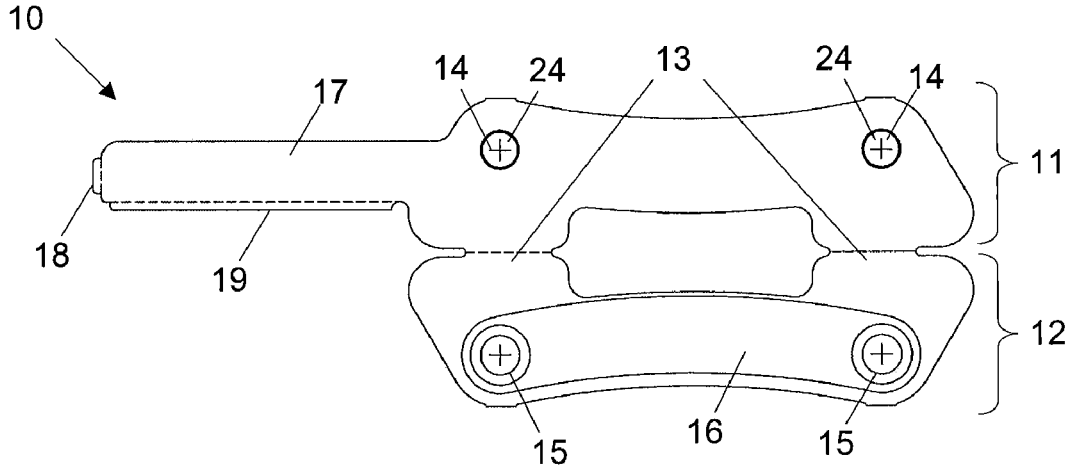
FIG. 1 is a perspective drawing of a two-hole punch in an open position.
Figure 2:
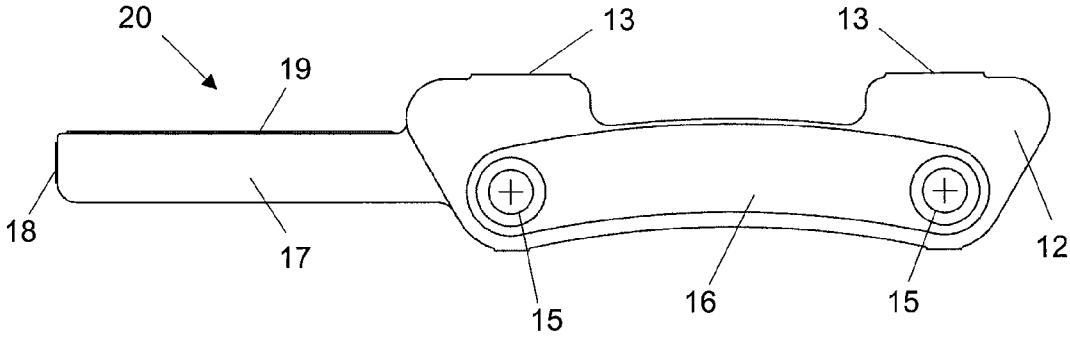
FIG. 2 is a perspective drawing of the two-hole punch of FIG. 1 in a closed position.

FIGS. 1 and 2 show an exemplary embodiment of a two-hole punch with alignment member and compressor. Element 10 shows the punch in an open, or unfolded, state, and element 20 shows the punch in a closed, or folded, state. The punch included two halves, a back half 11 and a front half 12, separated by a hinge 13. The hinge 13 may be continuous, or may be generally colinear segments that may or may not be connected. A gap between the segments with a recessed/exposed region will provide a visual indication that the paper to be punched is properly in place. Proper placement occurs when the top edge of the paper engages the hinge 13. This will insure that the top margin relative to the holes, is correct.

The back half 11 has two holes 14 that align with two holes 15 on the front half 12 when the punch is closed. One set of holes, say 14, has a raised cylindrical lip 24 extending around the diameter of the hole, so that the outside diameter of the raised cylindrical lip 24 fits snugly inside the inner diameter of the other set of holes, say 15. Alternatively, the raised cylindrical lip 24 may be on the other set of holes, or may be distributed with one on each half. When a piece of paper is inserted between the two halves of the punch and the punch is closed, the holes 14 and 15 punch holes in the paper. The diameter of the punched holes is roughly equal to the outer diameter of the raised cylindrical lip 24, and the spacing of the punched holes is roughly equal to the distance between the holes 14 and between the holes 15.

Alternatively, the punch may have more or fewer than two holes 14 and 15. For instance, a three-hole punch may be desired, using three holes 14 and three holes 15. As a further alternative, the spacing of the holes may be in accordance with U.S. conventions, European conventions, or any other standard or non-standard configuration. One use of the punch is as a substitute compressor used with twin pronged paper fasteners which allows the punch to always be accessible to the user because it is stored in the place of a compressor holding down papers and immediately available to punch papers when needed.

During use, the back half 11 may be held against a surface, such as a tabletop or a file folder, while the front half 12 may open and close freely. The front half 12 may have a pressable region 16, upon which the user may press to force the front half 12 into contact with the back half 11. The pressable region 16 may be structurally reinforced so that it does bend undesirably or become permanently distorted during use.

The back half 11 may contain an alignment arm or punch gauge 17, which is useful for positioning the paper before the holes are punched. For a page that is to receive holes along its top edge, the page is first positioned against a top guide 19 and a side guide 18. As a gauge, extension 17, it may include calibrations and stop 18 can be deleted to allow multiple size papers or placements to be aligned. The guides 18 and 19 may be raised portions of the alignment arm 17, or sidewalls (top and side) extending generally upwardly (orthogonally) from the extension of the arm, and may protrude generally perpendicular to the plane of the alignment arm 17. When first located against the guides 18 and 19, a page then receives holes in the proper locations, preferably symmetrically centered along a particular edge of the page, with the paper also visible in the gap between the hinges. Note that top guide 19 and side guide 18 are merely exemplary names, and need not correspond strictly to the top or side edges of a page.

The punch may be formed out of sheet metal, or may be another suitable material, such as a molded plastic. Alternatively, the punch may be formed from a combination of materials, such as a molded plastic body, with metallic reinforcements on each cylindrical lip and holes or other suitable cutter. In a preferred embodiment, the punch may be stored on the same binder that secures the contents of the file to the file itself. The binder typically has two metal or plastic strips that extend through the punched holes in the file contents and either fold perpendicular to the holes or removably attach to each other to prevent the contents of the file from falling out. Preferably, the punch itself may be stored on the binder when not in use, and the two metal or plastic strips may extend through the holes 14 and 15 and secure the punch to the file itself. Furthermore, the punch may replace an optional reinforcing element in the binder, which may be stored on the strips as the "last" document before the strips are bent, folded or attached to each other. The punch is removed from the strips during use, and may be replaced onto the strips when not in use. Alternatively, the punch may be attached to the file by an adhesive, (which includes a magnet, hook and loop—Velcro® system or other removable fixative, so that the back half 11 remains stuck to a particular location on the file, both during use and during non-use. The back side may also include a clip, such as that used on mobile phone holsters to clip the unit to a folder, binder, shirt pocket or belt.

Figure 3:
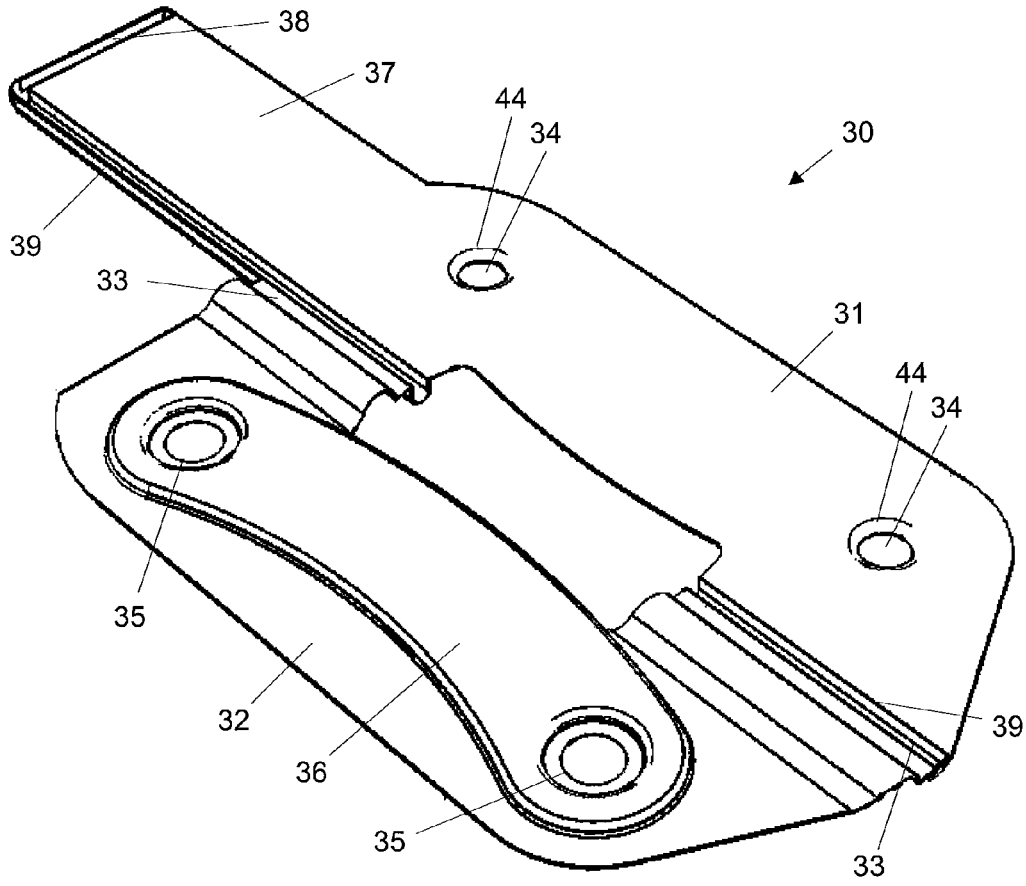
FIG. 3 is a perspective drawing of an alternate embodiment a two-hole punch in an open position.
Figure 4:
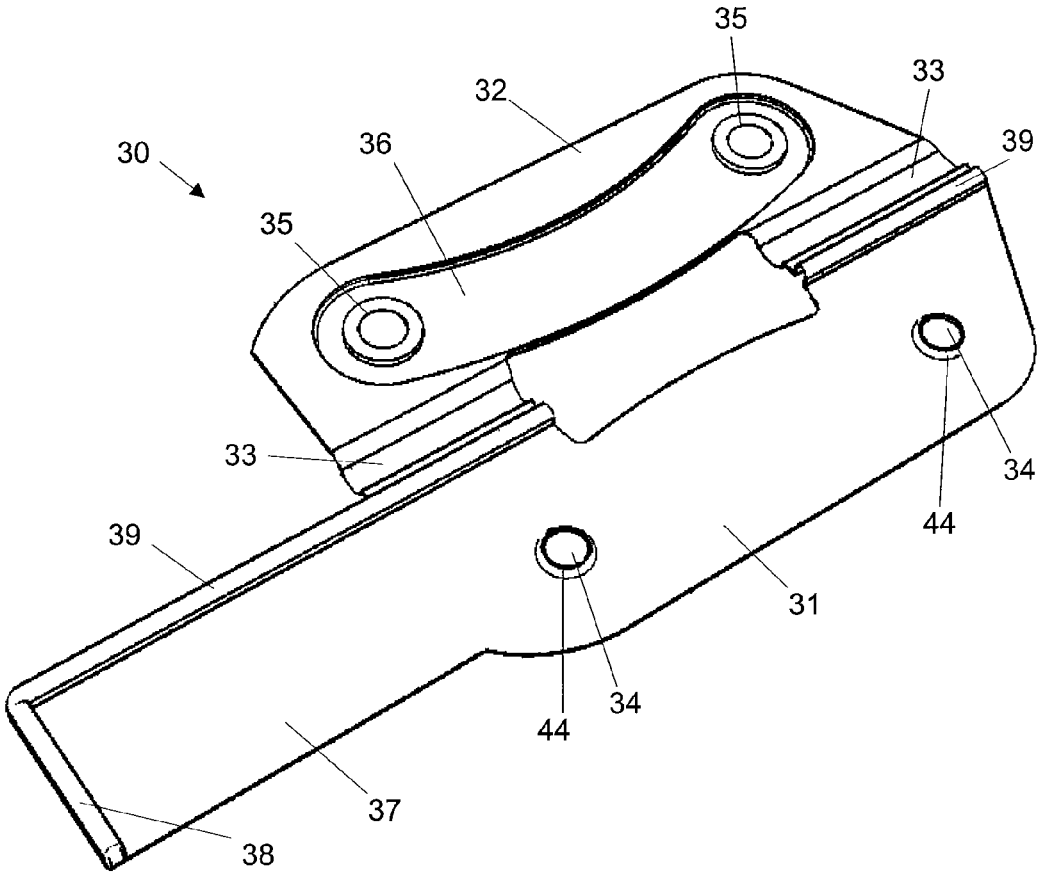
FIG. 4 is an alternate perspective drawing of the two-hole punch of FIG. 3 in an open position.

FIGS. 3 and 4 show another embodiment of a two-hole punch 30, shown in an open, or unfolded, state. A back half 31 is connected to a front half 32 by a hinge 33. Hinge 33 may comprise a series of parallel bends to create a spring effect. FIG. 4 illustrates a series of bends to form an accordion-like wavy, zig zag or sinusoid like pattern to create a spring effect in soft steel which would otherwise lack resilience. The punch 30 may be closed by folding the halves together. The view in FIG. 3 shows only the "outside" of the punch, where the "inside" of the punch is visible in FIG. 4. The back half 31 has a pair of holes 34, with a raised cylindrical lip 44 surrounding each hole 34. The front half 32 has a corresponding pair of holes 35, where the outer diameter of the raised cylindrical lip 44 fits snugly inside the inner diameter of the hole 35. The back half 31 has an alignment arm 37 with a side guide 38 and a top guide 39. Note that the top guide 39 may extend past the end of the alignment arm 37 and may optionally extend along the entire length of the hinge 33. To punch a pair of holes in a page, the page is first aligned to the top guide 39 and side guide 38, then the front half 32 is brought toward the back half 31 by pivoting the front half 32 about the hinge 33 into the page as drawn in FIG. 3, and out of the page as drawn in FIG. 4. The user then depresses the raised reinforced pressable region (strengthen by a ridge which surrounds, and perhaps encompasses, the space between the holes, forcing the raised cylindrical lip 44 through the page, and through the hole 35. The punch is then released, the halves are brought apart, and the page is removed, having a pair of new holes.

Figure 5:
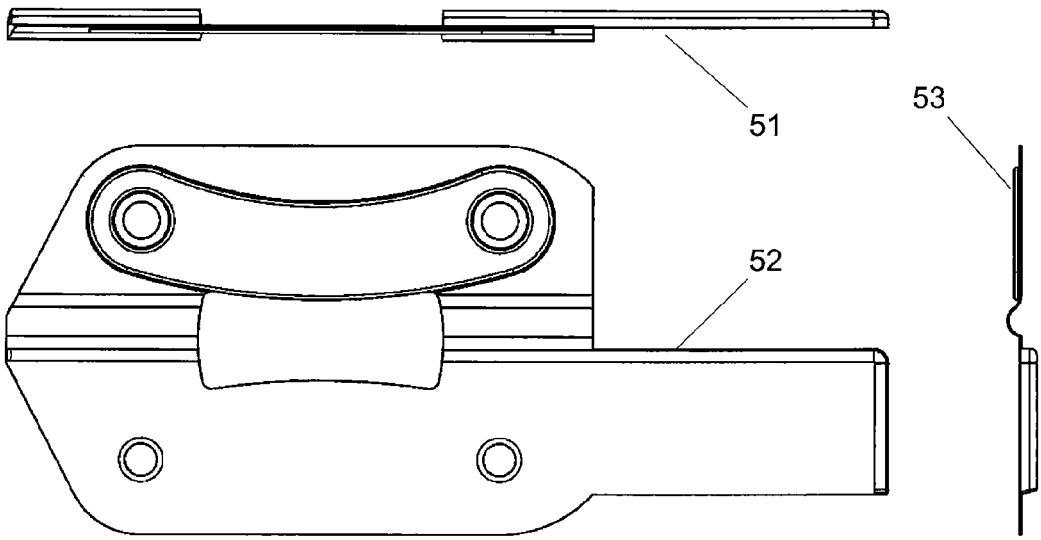
FIG. 5 is an orthographic projection of the two-hole punch of FIGS. 3 and 4 in an open position.

FIG. 5 shows the two-hole punch of FIGS. 3 and 4, in a top view 51, front view 52, and right-side view 53. The punch is shown in an open, or unfolded, position.

Figure 6:
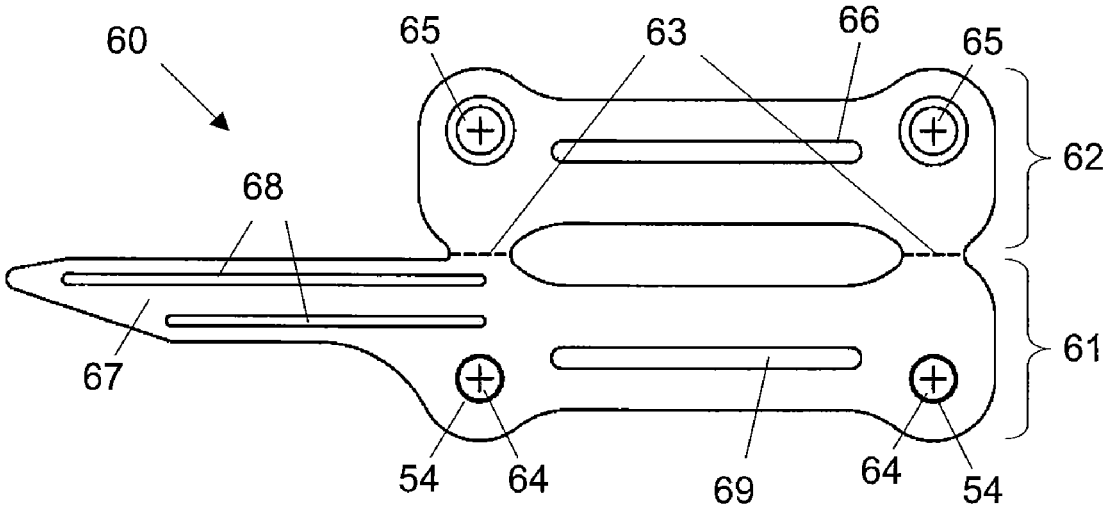
FIG. 6 is a perspective drawing of an embodiment of a two-hole punch with a letter opener.

FIG. 6 shows an embodiment of a two-hole punch 60 that includes a letter opener 67 and structural reinforcements 66, 67 and 68. A back half 61 is connected to a front half 62 by a hinge 63. The back half 61 has a pair of holes 64, with a raised cylindrical lip 54 surrounding each hole 64. The front half 62 has a corresponding pair of holes 65, where the outer diameter of the raised cylindrical lip 54 fits snugly inside the inner diameter of the hole 65. The back half 61 has a letter opener 67 with structural reinforcements 68 to reduce bending of the letter opener 67. The back half 61 and front half 62 each have structural reinforcements 69 and 66, respectively. The structural reinforcements may be indentations in the material, such as grooves. Alternatively, the structural reinforcements may be added material of the same type or a different type from the rest of the punch 60. Note that the punch 60 does not have an explicit guide or guide to position the paper before punching. The hinge 63 may be used to position an edge of the paper.

Figure 7:
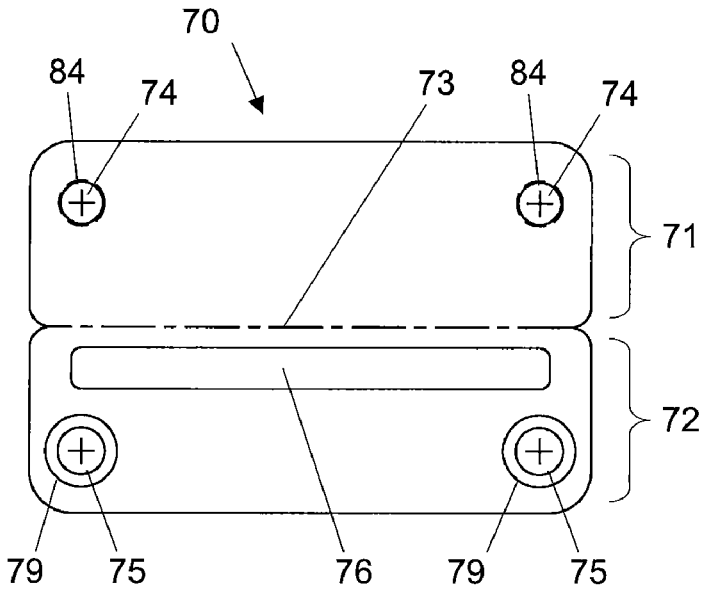
FIG. 7 is a plan drawing of an embodiment of a two-hole punch, in front view.
Figure 8:
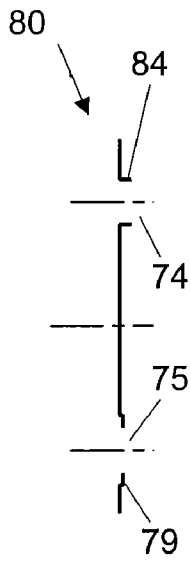
FIG. 8 is a section drawing of the two-hole punch of FIG. 7, in right side view.

FIGS. 7 and 8 show a front view 70 and a side view 80 of an embodiment of a two-hole punch. A back half 71 is connected to a front half 72 by a hinge 73. The back half 71 has a pair of holes 74, with a raised cylindrical lip 84 surrounding each hole 74. The front half 72 has a corresponding pair of holes 75, where the outer diameter of the raised cylindrical lip 84 fits snugly inside the inner diameter of the hole 75. The holes 75 have a hole reinforcing element 79 around them, which adds strength to the holes 75 and improves the efficiency of the punch. Note the section view 80 of FIG. 8, taken through the holes 74 and 75, in which the raised cylindrical lip 84 and the hole reinforcing element 79 are clearly shown. This embodiment is particularly well suited as a substitute compressor for the paper compress known in the art used with a pronged paper holder.

Figure 9:
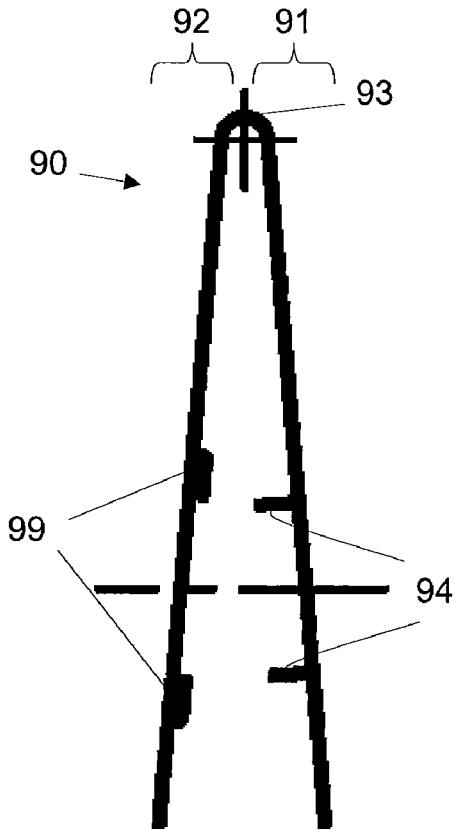
FIG. 9 is a plan drawing of the two-hole punch of FIG. 7 in right-side view, in nearly closed position.

FIG. 9 shows a side view 90 of the two-hole punch of FIGS. 7 and 8, folded into a nearly closed position. A back half 91 is connected to a front half 92 by a hinge 93. The back half 91 has a pair of holes (not shown), with a raised cylindrical lip 94 surrounding each hole. The two elements labeled 94 are the upper and lower portions of a single cylindrical lip, seen end-on. The front half 92 also has a pair of holes (not shown), each with a hole reinforcing element 99 around it. To punch a hole, a sheet of paper is inserted between the two halves 91 and 92, then the two halves are brought toward each other. The raised cylindrical lip 94 fits snugly inside the hole formed by the hole reinforcing element 99 in the front half 92, and produces a hole-shaped aperture in the inserted sheet of paper. The two halves are retracted from each other, and the holed paper is withdrawn.

Figure 10:
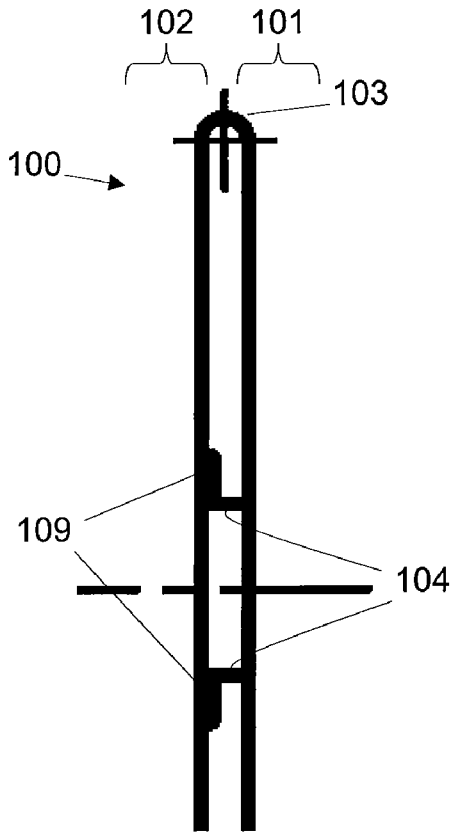
FIG. 10 is a plan view of the two-hole punch of FIG. 7 in right-side view, in closed position.

FIG. 10 shows a side view 100 of the two-hole punch of FIGS. 7-9, folded into a closed position. A back half 101 is connected to a front half 102 by a hinge 103. The back half 101 has a pair of holes (not shown), with a raised cylindrical lip 104 surrounding each hole. The front half 102 also has a pair of holes (not shown), each with a hole reinforcing element 109 around it.

Figure 11:
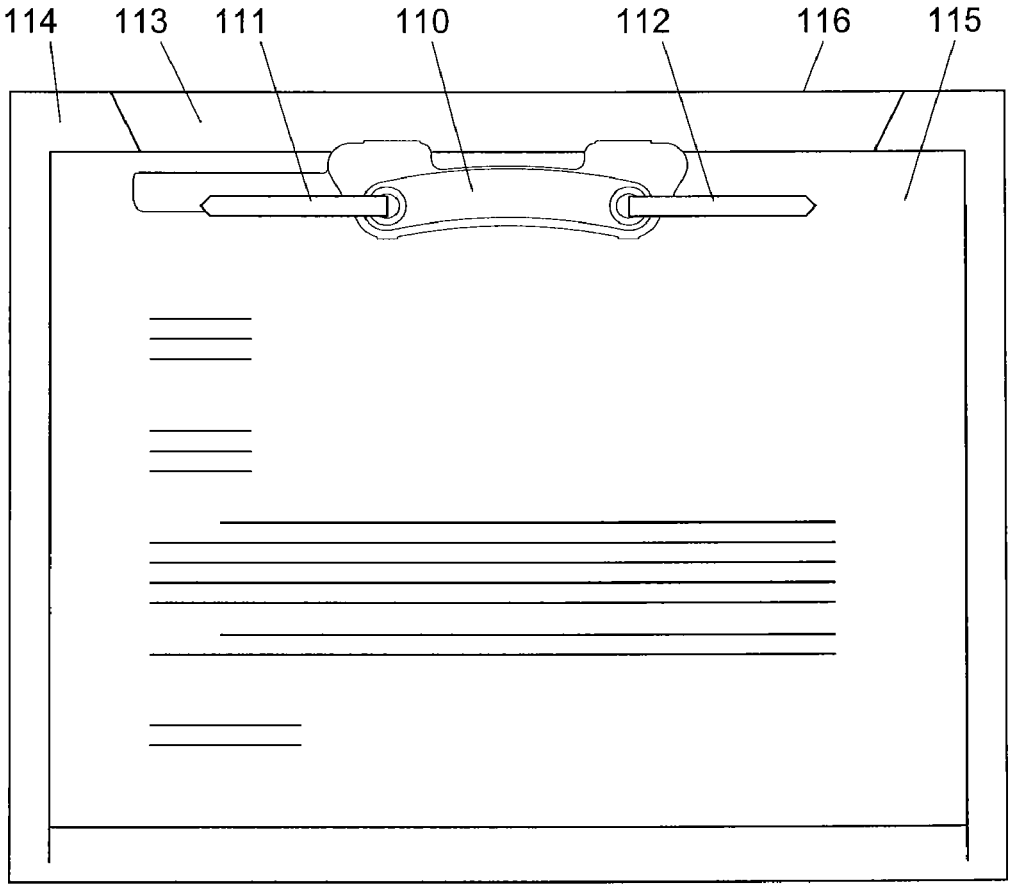
FIG. 11 is a plan view of a two-hole punch used as the compressor for a pronged paper holder.

FIG. 11 shows a two-hole punch 110 used as the compressor for a pronged paper holder. A folder 114 has a flap 113 that folds over an edge 116 of the folder 114. Two prongs 111 and 112 are fixedly attached to the flap 113 and are used to spindle the paper. The prongs 111 and 112 are generally made from metal, although a plastic or other suitable material may be used. To insert or remove pages 115 from the paper holder, the prongs 111 and 112 are bent perpendicular to the folder 114. Likewise, when the prongs 111 and 112 are bent parallel to the folder 114, the pages 115 are held in place. The two-hole punch 110 may be used as the compressor for the paper holder, i.e., the last element entered onto the prongs 111 and 112 before they are bent parallel to the folder 114. In this manner, the two-hole punch 110 may be stored with the folder, while simultaneously providing structural reinforcement for the punched holes in the pages 115.

The invention also includes a method of manufacturing a multifunction hole punch and paper compressor device for use on a multi-prong paper binder. One method includes the steps of:

a. Determining the standard prong spacing of a multi-prong binder. Different countries use different spacing and number of holes.

b. Folding over a single sheet material onto itself to form a pair of substantially planar members joined at one edge thereof. It is possible to use two separate members which are joined along one edge, instead of a single sheet.

c. Placing spaced apart apertures of the standard spacing in one of the planar members, said apertures being of predetermined diameter.

d. Forming similarly spaced apart apertures in the other planar member, the apertures of the planar members being coaxially aligned (i.e. upper and lower members mating).

e. Forming a circumferential lip on the inside circumference of the one set of apertures, said lip having an outer diameter smaller than said predetermined diameter. The preferred method is to use a punch of slightly greater diameter than the hole (but less that the inside diameter of the apertures in the other plate) and pressing the lip out of the material. This will create a sharp lip which create cutting engagement with the paper.

The result is a punch and compressor in a single unit so that said device may function both as a paper punch and a the compressor for the multi-pronged binder.

The invention also includes a method of using the multi-functioned punch as a compressor.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

I claim:

1. A multifunction paper punch-compressor device for use with a multi-prong paper binder having a generally planar portion affixable to a backing support and a pair of spaced apart bendable prongs extending from opposite ends of the planar portion, the prongs being freely bendable to form a retainer for papers, said paper punch-compressor device comprising:

a) a first elongated member having two first legs extending on both sides of a central line, the first elongate member having at least two spaced apart apertures on both sides of the central line;

b) a second elongated member having two second legs extending on both sides of the central line, the second elongated member having at least two spaced part apertures on both sides of the central line, said first legs and said second legs being pivotally and resiliently joined, the first and second elongated members having a relaxed state where said first and second elongated members define a gap therebetween at said apertures and a compressed state where said first and second elongated members are in at least partial contact, said apertures of said first and second elongated members being substantially co-axially aligned;

c) a plurality of hole punches formed on said first and second elongated members around said apertures, and configured to punch holes in the papers when said first and second elongated members are in the compressed state;

wherein said apertures on the first and second elongated members are spaced apart at a predetermined distance to receive said prongs, wherein the device provides a dual function as a compression plate and a hole punch, when the device functions as a hole punch, the device punches holes in the papers, when the device functions as a compression plate, said prongs extend through the apertures on the first and second elongated members and the punched holes on the papers, and are folded generally parallel to said first and second elongated members to compress the papers confined between the multi-prong binder;

d) an alignment arm extending from said first elongated member generally along an axis passing through said apertures on the first elongated member and from one side of a leg of said first elongated member, said alignment arm having a generally planar surface and being bounded by at least one sidewall extending generally orthogonally from said planar surface so that the papers are aligned against said side wall prior to punching to receive holes in a predetermined location, said second elongated member being shorter than said alignment arm so as to allow a user to easily see the position of the papers with respect to the alignment arm without occlusion.

2. The device of claim 1, wherein each aperture of the first elongated member has a raised cylindrical lip surrounding said aperture, and each aperture of said second elongated member being sized to receive said corresponding cylindrical lip so that when the elongated members are brought together, the raised cylindrical lips fits snugly inside the apertures on the second elongated member, thereby causing paper therebetween to be punched.

3. The device of claim 1, wherein said sidewall includes a top edge sidewall extending generally orthogonally from said planar surface along an axis generally parallel and spaced from said axis passing through the apertures, thereby creating a top edge alignment margin for the papers to be punched.

4. The device of claim 3 wherein said sidewall includes a side edge sidewall extending generally orthogonally from said planar surface along an axis generally perpendicularly to said axis passing through the apertures, thereby creating a side edge alignment for papers to be punched.

5. The device of claim 1 further including a magnet applied to a side of one of said elongated members facing away from the other member, so that the device may be attached to a surface.

6. The device of claim 1 further including a clip applied to a side of one of said elongated members facing away from the other member, so that the device may be attached to a surface.

* * * * *